US006354970B1

(12) United States Patent
Reinke et al.

(10) Patent No.: US 6,354,970 B1
(45) Date of Patent: Mar. 12, 2002

(54) CURVE BALL

(76) Inventors: Thomas E. Reinke; Walter G. Stelzer, both of N. 28 West 26715 Miami Dr., Pewaukee, WI (US) 53072

( * ) Notice: Subject to any disclaimer, the term of this patent is extended or adjusted under 35 U.S.C. 154(b) by 0 days.

(21) Appl. No.: 09/362,017

(22) Filed: Jul. 27, 1999

(51) Int. Cl.[7] ..... A63B 37/00
(52) U.S. Cl. ..... 473/600; 473/613
(58) Field of Search ..... 473/351, 378, 473/383, 384, 451, 597, 600, 613, 615; 273/FOR 111, DIG. 20

(56) References Cited

U.S. PATENT DOCUMENTS 1,150,761 A * 8/1915 Hartman
2,135,210 A * 11/1938 Farrar
2,776,139 A 1/1957 Blamey, Jr. et al.
3,863,923 A * 2/1975 Anderson
4,874,169 A * 10/1989 Litchfield
4,919,422 A * 4/1990 Ma
4,955,620 A 9/1990 Reinke
4,991,838 A * 2/1991 Groves
5,165,685 A * 11/1992 Hynes
5,280,906 A * 1/1994 Vitale
5,588,648 A * 12/1996 Stebbins
6,030,304 A * 2/2000 Simonutti
6,241,626 B1 * 6/2001 Sullivan et al.

* cited by examiner

*Primary Examiner*—William M. Pierce
(74) *Attorney, Agent, or Firm*—Andrus, Sceales, Starke & Sawall, LLP

(57) ABSTRACT

A curve ball is provided by a sphere having a non-perforated outer surface formed by a pair of hemispheres joined at an equator and having a pole axis extending through the center of the sphere perpendicularly to the plane of the equator. One of the hemispheres has at least one arcuate groove. The ball curves toward the groove when thrown in a direction along and coincident with the plane of the equator and spinning about the pole axis.

11 Claims, 1 Drawing Sheet

CURVE BALL

BACKGROUND AND SUMMARY

The invention relates to a curve ball, and is particularly useful in training baseball hitters.

Balls having configurations making them curve when thrown are known in the prior art. The present invention provides a curve ball which is particularly simple and easy to manufacture, and particularly effective in curving when thrown.

DETAILED DESCRIPTION OF THE INVENTION

Figure 1:
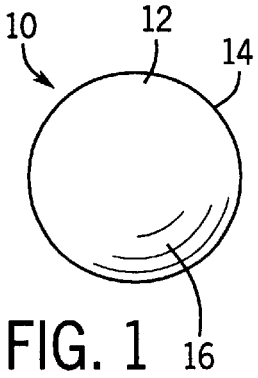
FIG. 1 is a left end elevation view of the ball of FIG. 2 showing a curve ball constructed in accordance with the invention.
Figure 2:
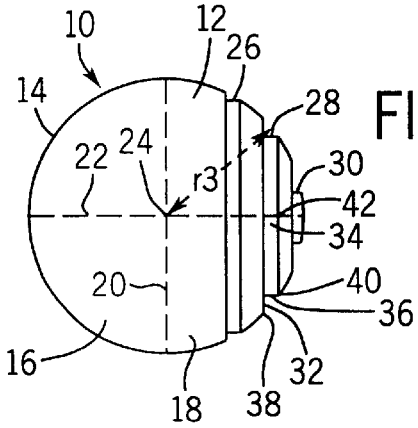
FIG. 2 is a side elevation view of a curve ball in accordance with the invention.
Figure 3:
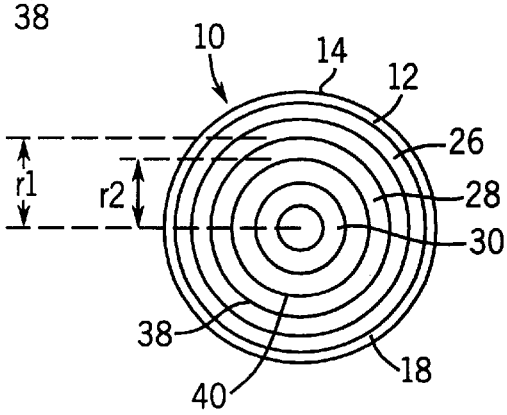
FIG. 3 is a right end elevation view of the ball of FIG. 2.

FIGS. 1–3 show a curve ball 10 provided by a solid sphere 12 having a non-perforated outer surface 14. The sphere is formed by a pair of hemispheres 16 and 18, FIG. 2, joined at an equator 20 and having a pole axis 22 extending through the center 24 of the sphere perpendicularly to the plane of equator 20. Left hemisphere 16 in FIG. 2 is shown in end elevation view in FIG. 1. Right hemisphere 18 in FIG. 2 is shown in end elevation view in FIG. 3. Right hemisphere 18 has a plurality of arcuate grooves 26, 28, 30. It has been found that ball 10 curves toward the grooves when thrown in a direction along and coincident with the plane of equator 20 and spinning about pole axis 22.

The arcs of respective grooves 26, 28, 30 lay in spaced respective planes parallel to each other and parallel to the plane of equator 20. Each groove is defined by a first grooved surface such as 32, FIG. 2, extending inwardly from outer surface 14 of sphere 12 along a line parallel to the plane of equator 20 and radially to relative to pole axis 22 and projecting through pole axis 22 at a point 34 spaced from the center 24 of sphere 12. Each groove is defined by a second grooved surface such as 36 extending along an axially projecting line parallel to pole axis 22. First grooved surface 32 meets outer surface 14 along a first arcuate edge 38. Second grooved surface 36 meets outer surface 14 along a second arcuate edge 40. First arcuate edge 38 is defined by a first constant radius rl from focal point 34 along pole axis 22 spaced from center 24 of sphere 12. Second arcuate edge 40 is defined by a second constant radius r2 from a second focal point 42 along pole axis 22 spaced from center 24 of sphere 12 by a distance greater than the spacing of first focal point 34 from center 24 of sphere 12. First and second arcuate edges 38 and 40 are separated by and face each other across an arcuate gap at 28 extending along the arc of outer surface 14 perpendicularly to first and second arcuate edges 38 and 40 and defined by a third constant radius r3 from center 24 of sphere 12, where r3>r1>r2. With the noted orientation of the groove, at initial release of the ball when thrown in the noted direction along and coincident with the plane of equator 20 and spinning about pole axis 22, air flows in a smooth uninterrupted channeled flow path along the groove. This provides better curving action and reduced wobble otherwise caused by perforations in the outer surface of a hollow ball or the like. In the preferred embodiment of the present invention, ball 10 is a solid member of polyurethane foam with a density of 6.63 pounds per cubic foot.

Figure 4:
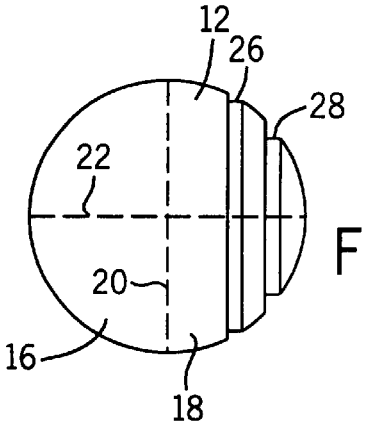
FIG. 4 is a side elevation view like FIG. 2 and shows another embodiment.
Figure 5:
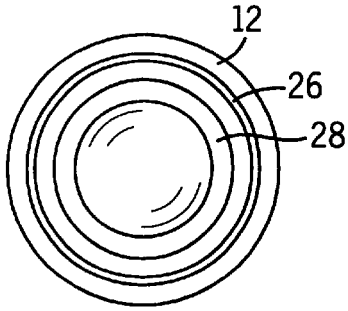
FIG. 5 is a right end elevation view of the ball of FIG. 4.

FIGS. 4 and 5 show another embodiment and use like reference numerals from FIGS. 1–3 where appropriate to facilitate understanding. In FIGS. 4 and 5, groove 30 is eliminated, and only two grooves 26 and 28 are used. It has been found that the heavier the ball, or the denser the material used, the more grooves are desired. In a further embodiment, only a single groove is used.

Figure 6:
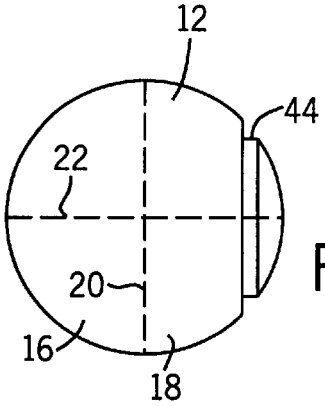
FIG. 6 is a side elevation view like FIG. 2 and shows another embodiment.
Figure 7:
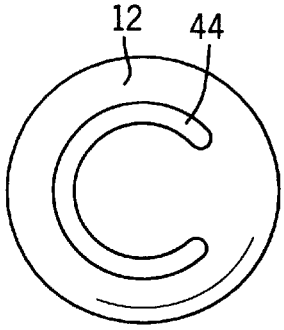
FIG. 7 is a right end elevation view of the ball of FIG. 6.

FIGS. 6 and 7 show a further embodiment and use like reference numerals from above where appropriate to facilitate understanding. In the embodiments of FIGS. 2–5, the grooves extend around the entire circumference of hemisphere 18 to define a respective circle having a respective diameter less than the diameter of equator 20. In FIGS. 6 and 7, groove 44 does not extend around the entire circumference of hemisphere 18, and instead has a C-shape in right end elevation view as shown in FIG. 7.

It is recognized that various equivalents, alternatives, and modifications are possible within the scope of the appended claims.

What is claimed is:

1. A curve ball comprising a sphere having a non-perforated outer surface, said sphere comprising a pair of hemispheres joined at an equator and having a pole axis extending through the center of said sphere perpendicularly to the plane of said equator, each of said hemispheres being solid and non-perforated such that no air can enter said ball, the entire outer surface of said ball being non-perforated, one and only one of said hemispheres having at least one arcuate groove, said ball curving toward said groove when thrown in a direction along and coincident with said plane of said equator and spinning about said pole axis, wherein said groove extends along a smooth interrupted arc along a plane parallel to said plane of said equator such that at initial release of said ball thrown along said thrown direction and spinning about said pole axis, air flows in a smooth uninterrupted channeled flow path along said groove.

2. The invention according to claim 1 wherein the arc of said groove lies in a plane parallel to said plane of said equator.

3. The invention according to claim 2 wherein said groove extends around the entire circumference of said one hemisphere to define a circle having a diameter less than the diameter of said equator.

4. The invention according to claim 1 wherein said one hemisphere has a plurality of arcuate grooves extending along spaced respective arcs lying in spaced respective planes parallel to each other and parallel to said plane of said equator.

5. The invention according to claim 1 wherein said groove is defined by a first grooved surface extending inwardly from said outer surface of said sphere along a line parallel to said plane of said equator and radially relative to said pole axis and projecting through said pole axis at a point spaced from said center of said sphere, and by a second grooved surface extending along an axial line parallel to said pole axis.

6. A curve ball comprising a sphere having a non-perforated outer surface, said sphere comprising a pair of hemispheres joined at an equator and having a pole axis emending through the center of said sphere perpendicularly to the plane of said equator, one and only one of said hemispheres having at least one arcuate groove, said ball curving toward said groove when thrown in a direction along and coincident with said plane of said equator and spinning about said pole axis, wherein said groove is defined by a first grooved surface extending inwardly from said outer surface of said sphere along a radial line parallel to said plane of said equator and projecting through said pole axis at a point spaced from said center of said sphere, and by a second grooved surface extending from said first grooved surface outwardly to said outer surface of said sphere, said first grooved surface meeting said outer surface at a first arcuate edge, said second grooved surface meeting said outer surface along a second arcuate edge, said first arcuate edge is defined by a first constant radius r1 from a first focal point along said pole axis spaced from said center of said spheres said second actuate edge is defined by a second constant radius r2 from a second focal point along said pole axis spaced from said center of said sphere by a distance greater than the spacing of said first focal point from said center of said sphere, said first and second arcuate edges are separated by and face each other across an arcuate gap extending along an arc perpendicular to at least one of said first and second arcuate edges and defined by a third constant radius r3 from said center of said sphere, where r3>r1>r2, wherein said groove extends along a smooth uninterrupted arc along a plane parallel to said plane of said equator such that at initial release of said ball thrown along said thrown direction and spinning about said pole axis, air flows in a smooth uninterrupted channeled flow path along said groove.

7. A curve ball comprising a sphere having a non-perforated outer surface, said sphere comprising a pair of hemispheres joined at an equator and having a pole axis extending through the center of said sphere perpendicularly to the plane of said equator, one of said hemispheres having at least once arcuate groove, said ball curving toward said groove when thrown in a direction along and coincident with said plane of said equator and spinning about said pole axis, wherein said groove does not extend around the entire circumference of said one hemisphere.

8. The invention according to claim 7 wherein said groove defines a C-shape in end elevation view.

9. A curve ball comprising a sphere having a non-perforated outer surface, said sphere comprising a pair of hemispheres joined at an equator and having a pole axis extending through the center of said sphere perpendicularly to the plane of said equators each of said hemispheres being solid and non-perforated such that no air can enter said ball, the entire outer surface of said ball being non-perforated, one and only one of said hemispheres having a groove extending along an arc defined by a constant radius from a focal point along said pole axis spaced from said center of said sphere, said ball curving toward said groove when thrown in a direction along and coincident with said plane of said equator and spinning about said pole axis, and wherein said groove extends along a smooth uninterrupted arc along a plane parallel to said plane of said equator such that at initial release of said ball along said thrown direction and spinning about said pole axis air flows in a smooth uninterrupted channeled flow path along said groove.

10. The invention according to claim 9 wherein said groove extends around the entire circumference of said one hemisphere to define a circle having a diameter less than the diameter of said equator.

11. The invention according to claim 9 wherein said one hemisphere has a plurality of arcuate grooves extending along spaced respective arcs defined by respective constant radii from respective focal points spaced along said pole axis from each other and from said center of said sphere.

* * * * *